US008861765B2

(12) United States Patent
Buck et al.

(10) Patent No.: US 8,861,765 B2
(45) Date of Patent: Oct. 14, 2014

(54) MICROPHONE COMPONENT AND METHOD FOR OPERATING SAME

(75) Inventors: Thomas Buck, Pittsburgh, PA (US); Franz Laermer, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 490 days.

(21) Appl. No.: 13/147,116

(22) PCT Filed: Jan. 15, 2010

(86) PCT No.: PCT/EP2010/050468

§ 371 (c)(1), (2), (4) Date: Oct. 12, 2011

(87) PCT Pub. No.: WO2010/086240

PCT Pub. Date: Aug. 5, 2010

(65) Prior Publication Data

US 2012/0076339 A1 Mar. 29, 2012

(30) Foreign Application Priority Data

Feb. 2, 2009 (DE) ..... 10 2009 000 535
Feb. 18, 2009 (DE) ..... 10 2009 000 950

(51) Int. Cl.
*H04R 3/00* (2006.01)
*H04R 19/01* (2006.01)

(52) U.S. Cl.
CPC ..... *H04R 3/007* (2013.01); *H04R 19/016* (2013.01)
USPC ..... 381/369; 381/111

(58) Field of Classification Search
USPC ..... 381/92, 369, 112
See application file for complete search history.

(56) References Cited

U.S. PATENT DOCUMENTS 7,365,669 B1 4/2008 Melanson
2003/0007650 A1* 1/2003 Akino ..... 381/113
2005/0231873 A1* 10/2005 Nell ..... 361/92
2006/0008097 A1* 1/2006 Stenberg et al. ..... 381/113
2009/0316935 A1* 12/2009 Furst et al. ..... 381/111

FOREIGN PATENT DOCUMENTS

| | | |
|---|---|---|
| CN | 1568094 | 1/2005 |
| DE | 10 2009 000950.7 | 8/2010 |
| JP | 2006-229336 | 8/2006 |
| JP | 2007-171203 | 7/2007 |
| WO | WO 2005/011122 | 2/2005 |
| WO | 2005/076466 | 8/2005 |

* cited by examiner

*Primary Examiner* — Duc Nguyen
*Assistant Examiner* — Phan Le
(74) *Attorney, Agent, or Firm* — Kenyon & Kenyon LLP

(57) ABSTRACT

A system and method are described for reducing the current consumption of a microphone component without adversely affecting performance. The system includes a micromechanical microphone capacitor, an acoustically inactive compensation capacitor, an arrangement for applying a high-frequency sampling signal to the microphone capacitor and for applying the inverted sampling signal to the compensation capacitor, an integrating operational amplifier which integrates the sum of the current flow through the microphone capacitor and the current flow through the compensation capacitor as a charge amplifier, a demodulator, which is synchronized with the sampling signal, for the output signal of the integrating operational amplifier, and a low-pass filter which uses the output signal of the demodulator to obtain a microphone signal that corresponds to the changes in capacitance of the microphone capacitor. The sampling signal is composed of a periodic sequence of sampling pulses and pause times. In addition, at least one first switching element is provided which reduces the current flow through the integrating operational amplifier during the pause times. The low-pass filter has a "sample-and-hold" characteristic so that during the pause times the low-pass filter in each case stores the output signal of the integrating operational amplifier averaged over the preceding sampling operation.

23 Claims, 4 Drawing Sheets

MICROPHONE COMPONENT AND METHOD FOR OPERATING SAME

FIELD OF THE INVENTION

The present invention relates to a microphone component having a micromechanical microphone capacitor, an acoustically inactive compensation capacitor, an arrangement for applying a high-frequency sampling signal to the microphone capacitor and for applying the inverted sampling signal to the compensation capacitor, an integrating operational amplifier which integrates the sum of the current flow through the microphone capacitor and the current flow through the compensation capacitor as a charge amplifier, a demodulator, which is synchronized with the sampling signal, for the output signal of the integrating operational amplifier, and a low-pass filter which uses the output signal of the demodulator to obtain a microphone output signal that corresponds to the changes in capacitance of the microphone capacitor. Moreover, the present invention relates to a method for operating such a microphone component.

BACKGROUND INFORMATION

Capacitive microelectromechanical system (MEMS) microphones are becoming increasingly important in various fields of application. This is essentially due to the miniaturized design of such components and the possibility for integrating additional functionalities at very low manufacturing costs. The integration of signal processing components such as filters and components for noise suppression, as well as components for generating a digital microphone signal, is particularly advantageous. Another advantage of MEMS microphones is their high temperature stability, which allows them to be installed in so-called "reflow solder processes," for example.

The microphone capacitor is generally composed of a diaphragm which is deflected by acoustic pressure and which acts as a movable electrode, and an acoustically inactive stationary counter electrode. The acoustic pressure causes the distance between the diaphragm and the counter electrode to change, and also results in a change in capacitance of the microphone capacitor. These very small changes in capacitance in the AF range must be converted into a usable electrical signal.

One concept frequently implemented in practice is based on charging the microphone capacitor with a direct-current voltage via a high-impedance charging resistor. Changes in capacitance of the microphone capacitor are then detected as fluctuations in the output voltage, which is amplified via an impedance converter. This may be a JFET, for example, which converts the high impedance of the microphone in the range of Gohm into a relatively low output impedance in the range of several 100 ohms without altering the output voltage itself. Instead of a JFET, an operational amplifier circuit may be used which supplies a low output impedance. In contrast to the JFET, in this case the amplifying factor may be adapted to the particular microphone requirements. This concept has proven to be problematic in several respects:

The digital circuit elements together with the analog signal processing components are not easily implemented in CMOS technology due to the occurrence of electrical noise, so-called "1/f noise." The JFET technology, which requires low noise, cannot be achieved within the scope of standard CMOS processes, and instead requires relatively costly specialized processes.

Electrostatic forces of attraction are present between the diaphragm and the counter electrode due to the direct-current voltage applied to the microphone capacitor during operation of the microphone. These electrostatic forces are critical in particular in overload situations, since they promote continuous adherence of the diaphragm to the counter electrode, resulting in a breakdown of the microphone function. To detach the diaphragm from the counter electrode, it is generally necessary to completely discharge the microphone capacitor. In practice, mechanical measures such as a relatively stiff diaphragm suspension, a relatively large distance between the diaphragm and the counter electrode, or mechanical stops, for example, have been attempted in order to avoid such electrostatic collapse. However, these measures usually have an adverse effect on the sensitivity of the microphone, or are very complicated from the point of view of the manufacturing process.

Lastly, it is noted that a relatively high direct-current voltage in the range of 10 volts and greater must be applied to the microphone capacitor to achieve a sufficiently high signal-to-noise ratio (SNR). However, a charging voltage in this range often requires a comparatively large distance between the diaphragm and the counter electrode in the range of >>2 μm or a very stiff diaphragm design, on the one hand to avoid electrostatic collapse, and on the other hand to provide a sufficiently large deflection range for the diaphragm. Such large distances or very stiff diaphragm designs are not easily provided using standard surface micromechanical methods. In addition, such high charging voltages in overload situations, with contact from the diaphragm and the counter electrode, result not only in adherence of the diaphragm to the counter electrode, but also irreversible melting of the contact surfaces due to current flow. In practice, attempts have been made to prevent this with the aid of insulating layers. However, these increase the complexity of the manufacturing process, and therefore ultimately increase the costs for such a microphone component.

German patent application 10 2009 000950.7 A1 proposes a microphone component of the type mentioned at the outset, which may be operated at a relatively low voltage level and still has a comparatively high sensitivity and SNR.

The concept on which this MEMS microphone is based provides that a high-frequency sampling signal is applied to the microphone capacitor, and the inverted clock signal is applied to an adjustable but acoustically inactive compensation capacitor. The sum of the current flow through the microphone capacitor and the current flow through the compensation capacitor is integrated with the aid of an integrating operational amplifier. The output signal of the integrating operational amplifier is then demodulated with the aid of a demodulator which is synchronized with the clock signal. Lastly, a microphone signal which corresponds to the changes in capacitance of the microphone capacitor is obtained by low-pass filtering of the demodulated signal.

In the case of DE 10 2009 000950.7 A1, the high-frequency sampling signal is a symmetrical clock signal in the form of a square wave voltage having a 1:1 ratio of the clock times.

The adjustable compensation capacitor is used for compensating for the current flow which flows through the microphone capacitor and is not due to acoustic effects. The aim is to operate the input of the subsequent charge amplifier close to its neutral voltage. Ideally, the compensation capacitor is adjusted corresponding to the quiescent capacitance of the microphone capacitor. Since the inverted clock signal is present at the compensation capacitor while the microphone capacitor is supplied with the clock signal, the operational amplifier integrates only the component of the current flow through the microphone capacitor which is due to the acoustically related changes in capacitance of the microphone capacitor, and therefore, the deviations from symmetry. Based on the output signal of the integrating operational amplifier, a microphone signal which reflects these changes in capacitance may then be obtained relatively easily, namely by synchronized demodulation and low-pass filtering.

At a voltage level of the high-frequency clock signal of less than 2 volts, this type of signal detection provides acceptable sensitivity, i.e., a sufficiently high SNR. This is also advantageous in particular in overload situations. Namely, for voltages in this range, contact between the diaphragm and the counter electrode does not result in melting of the contact surfaces, and therefore also does not result in destruction of the microphone structure. For this reason, mechanical overload protection in the form of electrically insulating stops may be dispensed with here. In addition, the micromechanical structure of this microphone component as well as the circuitry components thereof for signal detection may be produced using standard processes of MEMS technology or CMOS technology, and therefore in a very cost-effective manner.

Due to the small installation size, the relatively high sensitivity, and the low manufacturing costs, the microphone component discussed in DE 10 2009 000950.7 A1 is very well suited for use in mass-produced portable devices such as mobile telephones, for example. For such applications the power consumption of the microphone component must be kept as low as possible. A primary power consumer of the microphone component discussed in DE 10 2009 000950.7 A1 is the integrating operational amplifier, which is operated as a low-noise charge amplifier.

SUMMARY OF THE INVENTION

The exemplary embodiments and/or exemplary methods of the present invention provide for reducing the power consumption of a microphone component of the type mentioned at the outset which does not adversely affect either the microphone performance or the microphone response.

The exemplary embodiments and/or exemplary methods of the present invention provide that a periodic sequence of sampling pulses and pause times is used as a high-frequency sampling signal. During the pause times the current flow through the integrating operational amplifier is reduced with the aid of a first switching element, and the current flow through other circuit components not needed during the pause times is also optionally reduced. According to the exemplary embodiments and/or exemplary methods of the present invention, the low-pass filter has a "sample-and-hold" characteristic, so that in the pause times the low-pass filter in each case stores the output signal of the integrating operational amplifier, time-averaged over the preceding sampling operation. In the case of a digital output signal, a binary bit value is simply stored during the pause times.

Accordingly, the time sequence of the sampling process is modified from the operating variant discussed in DE 10 2009 000950.7 A1, in that pause times are inserted between the actual sampling operations. According to the exemplary embodiments and/or exemplary methods of the present invention, use is made of the fact that the acoustic signal to be detected by the microphone component varies in a frequency range below approximately 25 kHz, while the sampling rate of a high-frequency clock signal is usually in the MHz range, for example >500 kHz. As long as the pause times are selected in such a way that the sampling rate is at least twice as great as the highest acoustic frequency to be detected, the modification of the sampling process according to the present invention does not adversely affect the quality of the microphone signal. According to the exemplary embodiments and/or exemplary methods of the present invention, it has also been recognized that the integrating operational amplifier contributes to generating the microphone signal only during the sampling operations, but not during the pause times. Therefore, the current flow through the operational amplifier may be greatly reduced during the pause times when the output signal of the operational amplifier, averaged over each sampling operation, is stored over each subsequent pause time. This is ensured according to the exemplary embodiments and/or exemplary methods of the present invention by a sample-and-hold characteristic of the downstream low-pass filter. In addition, other circuit components not needed during the pause times may be switched off, or their power consumption may be reduced.

Since the integrating operational amplifier contributes significantly to the power consumption of the microphone component under discussion, the overall power consumption may be reduced very effectively by modifying the sampling operation according to the exemplary embodiments and/or exemplary methods of the present invention. In one particularly power-saving operating variant, the integrating operational amplifier is completely switched off during the pause times, i.e., the power consumption of the operational amplifier is set to zero.

In one variant of the microphone component according to the present invention, the demodulator connected downstream from the integrating operational amplifier includes at least a second switching element via which the electrical connection between the integrating operational amplifier and the downstream low-pass filter is interrupted during the pause times.

In principle, there are various options for implementing the sampling of the microphone capacitance according to the present invention, which concern the duration of the pause times as well as the sequence of the sampling pulses and pause times, as long as the sampling rate is effectively at least twice as great as the highest acoustic frequency to be detected.

In one advantageous variant, the sampling signal is composed of a periodic sequence of alternating positive and negative sampling pulses, in each case followed by a defined pause time. In this variant, the sampling signal known from DE 10 2009 000950.7 A1 is thus modified by inserting defined pause times between the individual sampling pulses. Thus, no new additional frequencies are introduced into the sampling operation, so that interferences or side effects from multiple frequencies in the sampling process, i.e., higher-order aliasing phenomena, are prevented.

In this variant of the sampling signal, the reduction according to the present invention of the current flow through the integrating operational amplifier during the pause times is accompanied by a corresponding reduction in the correlation of the 1/f noise signal between the successive sampling pulses. This correlation is completely lost when the operational amplifier is switched off. This makes it more difficult to efficiently suppress the 1/f noise, also referred to as "flicker noise," which is very pronounced in the relevant frequency range here. Therefore, in this specific embodiment of the sampling the charge amplifier is not completely switched off, but instead is supplied with a minimum quiescent current during the pauses so that the noise correlation between the individual sampling operations is not lost.

This problem is taken into account in another advantageous variant of the sampling signal which is composed of a periodic sequence of two directly successive sampling pulses of opposite polarity and a defined pause time. In this variant, the noise correlation of the 1/f noise component between the two directly successive sampling pulses is maintained, regardless of how greatly the current flow through the operational amplifier is reduced during the pause times. Even when the noise correlation is not maintained over the pause times, the "flicker noise" component may be effectively suppressed. However, in this case two frequencies are involved in the sampling operation, namely, on the one hand the rapid repetition frequency of the sampling pulses, which is in the range of 500 kHz and higher, for example, and on the other hand the slower sampling frequency, i.e., the repetition rate of the sampling sequences, which is usually in the range of 50 kHz. At the output the low-pass filter must be designed, corresponding to this sampling frequency, with a steep drop characteristic above its cutoff frequency in order to suppress crosstalk of the sampling pulses themselves or of the sampling operations on the output. In addition, as the result of an input-side suppression of microphone signals above one-half of the lowest sampling frequency it must be ensured that no aliasing phenomena may occur.

In the above-mentioned sampling variant, the reduction in the effective power consumption of the integrating operational amplifier may be determined based on the "duty cycle" value r, where r is defined as the time relationship:

$$r=(\text{sampling pulse1}+\text{sampling pulse2})/(\text{sampling pulse1}+\text{sampling pulse2}+\text{pause}).$$

When the integrating operational amplifier is switched off during the pause times, the average power consumption is reduced by the factor r, compared to the operating variant in which the current flow through the operational amplifier is not reduced.

As indicated above, the noise downstream from the demodulator increases as a result of this sampling, specifically by the factor 1/sqrt(r). This increase in noise level N in signal-to-noise ratio SNR=S/N may be compensated for by a corresponding increase in microphone signal level S. For this purpose, for example, the sampling voltage may simply be increased by the factor 1/sqrt(r). Another option for increasing the microphone signal level is to reduce the designed gap space in the MEMS microphone. The signal level of the microphone signal may also be increased by a combination of gap reduction and increase in the sampling voltage. It is advantageous that the risk of electrostatic collapse of the microphone structure is not increased, provided that these measures are used only to compensate for the sampling-related noise, using the stated factors as boundary conditions. Namely, the electrostatic force acting on the microphone diaphragm increases with the square of the applied voltage, i.e., ~1/r, and with the time period over which this voltage is effectively applied, i.e., ~r. The effect of a voltage increased by 1/sqrt(r) which is applied only in time relationship r therefore always corresponds to the effect of a clock signal, as discussed in DE 10 2009 000950.7 A1, which is not a problem for the function of the microphone component.

In one particularly advantageous specific embodiment of the present invention, the compensation capacitor is automatically adapted to the quiescent capacitance of the microphone capacitor. This regulation is based, for example, on the direct-current voltage component of the demodulator output signal, since this direct-current voltage component corresponds to the quasi-static asymmetry between the microphone capacitor and the compensation capacitor. The direct-current voltage component may be ascertained very easily with the aid of an offset filter provided downstream from the demodulator. To ensure that only the direct-current voltage component is actually filtered out, the upper limiting frequency of this offset filter should be considerably less than the lower limiting frequency of the microphone. The compensation capacitor is then easily adjusted in such a way that the direct-current voltage component of the demodulator output signal is minimized.

For this purpose, the adjustable compensation capacitor may be implemented in the form of a switchable capacitor bank, for example. This switchable capacitor bank may include a binary distribution of capacitance values and/or a series of identical capacitance values which are optionally interconnected. Instead of varying the compensation capacitor, the alternating voltage amplitude of the inverted clock signal at the compensation capacitor may also be adjusted via a resistor series or a voltage divider. Varying the voltage level by changing the current through the compensation capacitor has an effect equivalent to a change in the capacitor value. Since the connection of very small capacitance values in the range of a femtofarad may be difficult to control, a combination of both methods is very advantageous. The rough adjustment is made using switched capacitors, and the fine adjustment is made by slightly varying the voltage level.

The compensation capacitor is advantageously adjusted in steps in order to take the dynamics of the system into account. Depending on the type of capacitor bank and/or resistor series used, various approximation strategies may be applied. For a capacitor bank or resistor bank having a series of identical capacitance or impedance values, respectively, a linear approximation is recommended. A binary search algorithm may be implemented more easily using a capacitor bank whose capacitance values have a binary distribution, thus, whose successive capacitance values are in a 2:1 ratio.

It is reasonable to initialize the compensation capacitor when the microphone component is switched on (so-called "reset to power-up"). In this case, the compensation capacitor is thus automatically adapted before the actual operation of the microphone, during the initialization phase after the supply voltage of the microphone is switched on.

In one particularly advantageous refinement of the present invention, however, the direct-current voltage offset of the output signal of the demodulator is detected not during this initialization phase, but, rather, during the actual operation of the microphone in order to monitor the functionality of the microphone and to carry out early recognition of overload situations, in particular an electrostatic collapse of the electrodes of the microphone capacitor, and to take appropriate countermeasures.

If physical contact occurs between the movable diaphragm and the stationary counter electrode in an overload situation, the microphone capacitor becomes very large. At this moment the direct-current voltage component increases very rapidly. The diaphragm generally remains adhered to the counter electrode due to the electrostatic conditions. In one advantageous specific embodiment of the present invention, such an overload situation is detected based on the increase or the level of the direct-current voltage offset signal. For this purpose, the direct-current voltage offset is periodically compared to a predefined maximum limiting value or "window range." If the direct-current voltage offset exceeds this maximum limiting value or "window range," an electrical reset is automatically carried out, for example after a certain waiting period or measuring time, in which the microphone capacitor is discharged in order to detach the diaphragm from the counter electrode and restore the microphone function. Thus, in this variant of the present invention a type of overload protection for the microphone component is achieved solely by circuitry. In this case corresponding mechanical measures may be dispensed with, which overall greatly simplifies the manufacturing process for the component according to the present invention.

The monitoring of the direct-current voltage component may also be used to readjust the setting of the compensation capacitor during operation of the microphone, for example to counteract long-term drift phenomena. For this purpose, in one advantageous refinement of the present invention, the compensation capacitor is also automatically adjusted during operation of the microphone, in particular whenever over a fairly long time period the direct-current voltage offset departs from a tolerance band which is specified by a further limiting value or window range. This second limiting value is selected to be much smaller than the maximum limiting value which indicates the electrostatic collapse. This is explained in greater detail below with reference to one exemplary embodiment of the present invention.

In one particularly advantageous refinement of the present invention, the direct-current voltage component of the demodulated signal is used not only for adapting the compensation capacitor and/or for monitoring the microphone function, but also for detecting accelerations which act on the microphone component. Use is made of the fact that basically any capacitive microphone structure is also sensitive to accelerations such as the acceleration due to gravity, for example. If an acceleration acts perpendicularly to the microphone diaphragm, the microphone diaphragm is deflected due to its mass and flexible suspension, resulting in a corresponding change in capacitance. These are generally static, or at least very low-frequency, changes in capacitance which are reflected in the signal curve of the direct-current voltage component. Thus, when the signal curve of the direct-current voltage component is appropriately evaluated, the concept according to the present invention allows the detection of accelerations acting perpendicularly to the microphone diaphragm without the need for an additional sensor element. Thus, using this concept, it is possible not only to implement a very inexpensive microphone having comparatively high sensitivity and robustness, but also to detect motions or merely only changes in position of the built-in device, without additional sensor elements. The component according to the present invention could be used, for example, within the scope of a telephone or PDA in order to recognize whether the device is moved or is resting on a table, and then to automatically switch between a vibrating alarm and a ring. For a telephone application, individual control actions such as, for example, switching a keylock on or off or accepting or refusing an incoming call, could be initiated via simple gestures, for example by rotating the device about a certain axis.

As previously mentioned, the acceleration information is ascertained from the very low-frequency signal component of the demodulated signal. This low-frequency signal component of <100 Hz, for example, may be obtained by appropriate further low-pass filtering of the output signal of the demodulator, or may also be separated from the microphone signal with the aid of a simple low-pass filter, while an optional high-pass filter simulates the behavior of classical microphones at the output. Such a high-pass filter is optional, since a high-pass filter for capacitive decoupling is present anyway in typical input circuits for microphones. A suitable low-pass filter may be technically implemented at various locations. For example, the low-pass filter may be integrated into the ASIC, so that the acceleration may be picked up via an additional pin. Another option is to implement the low-pass filter on the motherboard in the form of discrete components. The low-pass filter may also be integrated into the signal processing switching circuit, for example in the chipset of a mobile telephone. Lastly, for a digital microphone signal the low-pass filter may also be implemented strictly as software, which is particularly appealing, since in this case no additional components or circuit changes are necessary.

As previously stated, there are various options for advantageously embodying and refining the teaching of the present invention. For this purpose, reference is made on the one hand to the patent claims subordinate to the independent patent claims, and on the other hand to the following description of one exemplary embodiment of the present invention with reference to the figures.

DETAILED DESCRIPTION

A primary part of the component discussed in DE 10 2009 000950.7 A1 and also of the component according to the present invention is a micromechanical microphone structure which includes an acoustically active diaphragm and a stationary acoustically permeable counterelement. The diaphragm and the counterelement form the deflectable electrode and the stationary electrode, respectively, of a microphone capacitor. As the result of an acoustic effect, the distance between the diaphragm and the counter electrode, and therefore also the capacitance of the microphone capacitor, changes.

Figure 1:
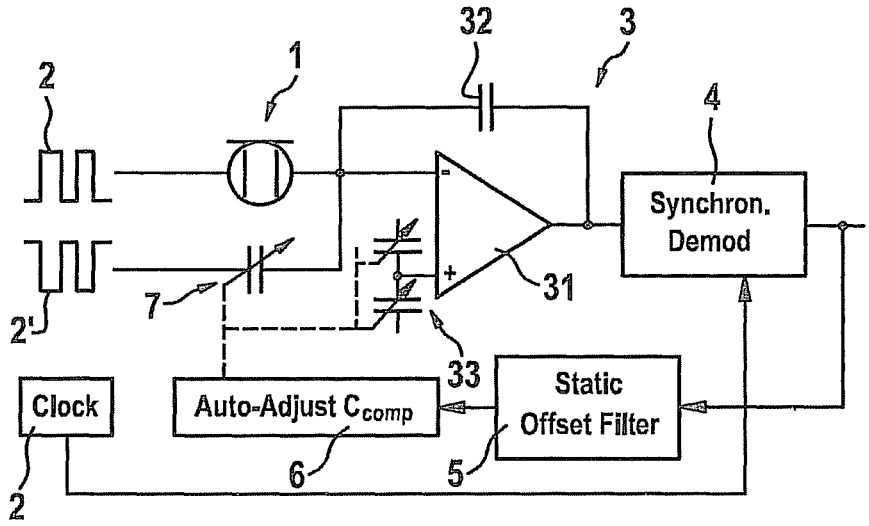
FIG. 1 shows a schematic wiring diagram of a microphone component according to DE 10 2009 000950.7 A1.

For the component illustrated in FIG. 1 and discussed in DE 10 2009 000950.7 A1, microphone capacitor 1 is acted on by a sampling signal in the form of a high-frequency clock signal 2 in order to detect these changes in capacitance. The resulting current flow through microphone capacitor 1 is supplied to an input of a charge amplifier 31.

In addition to acoustically active microphone capacitor 1, this component includes an acoustically inactive adjustable compensation capacitor 7. The acoustically inactive adjustable compensation capacitor is designed to compensate for the current which flows through microphone capacitor 1 in the quiescent state when the latter is acted on by the high-frequency clock signal. For this purpose, adjustable compensation capacitor 7 is supplied with inverted clock signal 2'. The resulting current flow through compensation capacitor 7 is likewise supplied to the above-mentioned input of charge amplifier 31.

Operational amplifier 31 together with capacitor 32 forms an integrating charge amplifier 3 which integrates the sum of the current flows through the two capacitors 1 and 7.

Ideally, compensation capacitor 7 is adjusted in such a way that its capacitance corresponds to the quiescent capacitance of microphone capacitor 1. In the present case, the two current flows in the quiescent state of microphone capacitor 1 largely cancel out one another except for the deviations due to the acoustically related fluctuations in capacitance of microphone capacitor 1. Only these deviations are subsequently integrated with the aid of integrating operational amplifier 3.

In order to obtain a microphone signal from the output signal of integrating operational amplifier 3 which reflects the acoustically related fluctuations in capacitance of microphone capacitor 1, this output signal is supplied to a demodulator 4 which is synchronized with clock signal 2. An analog microphone signal may then be obtained from the demodulated signal via suitable low-pass filtering. A digital microphone signal may alternatively be directly obtained by additional use of a sigma-delta conversion, for example, the digital microphone signal being synchronized with the system clock of the built-in device (mobile telephone, PDA, etc.).

In this case, compensation capacitor 7 is automatically adjusted, specifically during the initialization or compensation phase of the microphone component after its supply voltage is switched on. For this purpose, the output signal of demodulator 4 is supplied to a low-pass filter 5 whose upper limiting frequency is designed to be considerably less than the lower limiting frequency of the microphone. With the aid of this low-pass filter 5 the direct-current voltage component of the demodulated signal is ascertained, and thus the static asymmetry between microphone capacitor 1 and compensation capacitor 7, is ultimately ascertained. Compensation capacitor 7 is then automatically modified with the aid of a regulating stage 6 in such a way that the direct-current voltage component is minimized. This regulation may be started in a time-delayed manner in such a way that the controller is not initiated until after a certain waiting period during which an impermissible deviation is consistently present.

At this point it is noted that the direct-current voltage offset signal does not necessarily have to be obtained directly from the output signal of demodulator 4, and instead may be obtained from the output signal of a subsequent or preceding processing step, provided that the direct-current voltage component has not yet been filtered out.

For the microphone component illustrated in FIG. 1, a reference capacitor system 33 is provided upstream from the reference input of charge amplifier 31, the reference capacitor system likewise being regulated with the aid of regulating stage 6, i.e., on the basis of the monitored direct-current voltage offset signal, in order to achieve optimum noise and interference signal suppression with respect to the supply voltage.

The differences in particular with respect to the microphone concept discussed in DE 10 2009 000950.7 A1 are explained below with the aid of the wiring diagram of a microphone component according to the present invention illustrated in FIG. 2.

Figure 2:
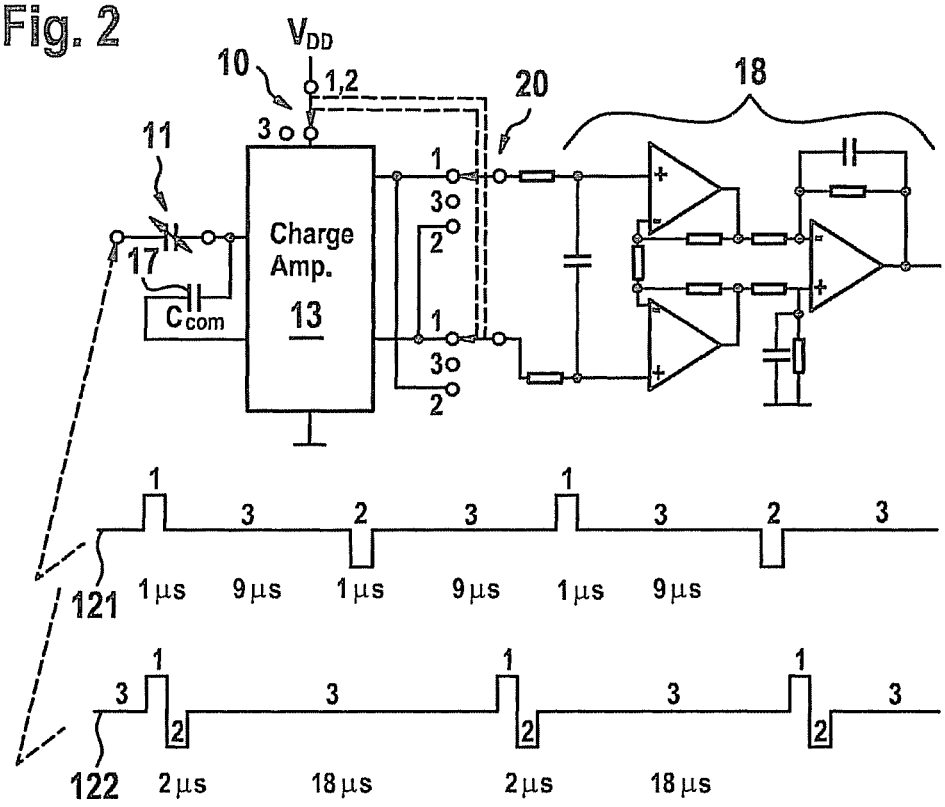
FIG. 2 shows a schematic wiring diagram of a microphone component according to the present invention.

The microphone component illustrated in FIG. 2 also includes a microphone capacitor 11 and an acoustically inactive adjustable compensation capacitor 17. For detecting the acoustically related changes in capacitance of the microphone capacitor, the microphone capacitor is acted on by a high-frequency sampling signal 121 or 122, while the compensation capacitor is supplied with the inverted sampling signal. The resulting current flow through microphone capacitor 11 and the resulting current flow through compensation capacitor 17 are supplied to the appropriate input of an integrating operational amplifier 13 which integrates the sum of the current flows through the two capacitors 11 and 17 in the sense of a charge amplifier.

The same as for the microphone component illustrated in FIG. 1, compensation capacitor 17 is adjusted in such a way that its capacitance corresponds as closely as possible to the quiescent capacitance of microphone capacitor 11. In the present case, the two current flows in the quiescent state largely cancel out one another except for the deviations due to the acoustically related fluctuations in capacitance of microphone capacitor 11. Only these deviations are subsequently integrated with the aid of integrating operational amplifier 13, and result in a dynamic output signal.

According to the exemplary embodiments and/or exemplary methods of the present invention, the time sequence of the sampling process has been modified from the microphone concept explained in conjunction with FIG. 1. Instead of a high-frequency symmetrical clock signal 2, 2' in the form of a square wave voltage having a 1:1 ratio of the clock times, a sampling signal composed of a sequence of sampling pulses and pause times is applied to capacitors 11 and 17. Thus, in this case the symmetrical clock signal has been modified by inserting defined pause times between individual sampling pulses or sampling sequences. FIG. 2 illustrates, only as an example, two sampling signals 121 and 122 modified in this way, having sampling pulses I and II of opposite polarity. In the case of sampling signal 121, time pauses III are present between these sampling pulses I and II, while sampling signal 122 is illustrated as a periodic sequence of pause times III and sampling sequences composed of two directly successive sampling pulses I and II.

During pause times III the current flow through integrating operational amplifier 13 is greatly reduced or even switched off. For this purpose a first switching element 10 is provided which in the exemplary embodiment illustrated here disconnects operational amplifier 13 from supply voltage $V_{DD}$ during pause times III, and which in this regard is synchronized with sampling signal 121 and 122. In addition, other circuit components which are not needed may be switched off during the pause times. This first switching element 10 is also synchronized with a second switching element 20 at the output of integrating operational amplifier 13. With the aid of this second switching element 20, the output of integrating operational amplifier 13 is connected, in each case synchronously, to a downstream low-pass filter circuit 18 only during the actual sampling, i.e., for sampling pulses I and II. During pause times III, this connection remains interrupted in each case. The output signal of integrating operational amplifier 13 is thus demodulated synchronously with the sampling operations, and a so-called sample-and-hold characteristic is achieved.

According to the exemplary embodiments and/or exemplary methods of the present invention, low-pass filter circuit 18 has a sample-and-hold characteristic, so that although it is electrically disconnected from the output of integrating operational amplifier 13 during pause times III, it stores the voltage state resulting from the preceding sampling operation over pause time III. In the exemplary embodiment illustrated here, the sample-and-hold low-pass filter is implemented in the form of a so-called instrumentation amplifier. However, the exemplary embodiments and/or exemplary methods of the present invention also includes alternative specific embodiments having equivalent or superior functionality. Thus, for example, a higher-order low-pass filter having one or multiple poles may also be used in conjunction with a sample-and-hold function. For a digital output circuit, the digital low-pass filter then simply buffers a "counter value" as a bit word during the pauses, or outputs same as a "bit stream."

As previously mentioned, in the case of sampling signal 121 a defined pause time III is inserted in each case between individual sampling pulses I and II of the symmetrical clock signal known from DE 10 2009 000950.7 A1. In the present case, the sampling rate of the sampling operation is in a range around 100 kHz. Since the sampling operation does not include any other frequencies, interferences or side effects caused by multiple frequencies in the sampling process, i.e., higher-order aliasing phenomena, are prevented.

However, in this simple sampling concept the correlation of the 1/f noise signal between sampling times I and II is reduced due to the current reduction in integrating operational amplifier 13 during pause times III. In the event of a current shutoff, this correlation is even completely lost. Therefore, when sampling signal 121 is used it is not possible to ensure efficient suppression of the 1/f noise component to the original extent, which is very pronounced in the relevant frequency range of around 100 kHz here, and dominates over the thermal noise which is uniformly distributed over all frequencies. Thus, in this variant of the sampling concept, operational amplifier 13 is preferably provided with a minimum quiescent current>0, also during the pauses, in order to maintain a noise correlation.

Sampling signal 122 takes the requirement for efficient noise suppression into account in that pause times III are not inserted between the individual sampling pulses, but instead between sampling sequences composed of two directly successive sampling pulses I and II of opposite polarity. Between sampling pulses I and II of a sampling sequence there is a maximum correlation of the 1/f noise which allows efficient noise suppression in the demodulator, regardless of whether or not the noise correlation is maintained between the individual sampling sequences, i.e., over the pause times. Therefore, in the case of sampling signal 122 the current flow through the integrating operational amplifier is largely reduced, or even completely switched off, during the pause times, regardless of whether noise correlations are maintained.

However, in this sampling concept two frequencies are involved in the sampling operation, namely, the rapid repetition frequency of sampling pulses I and II within the sampling sequences, which lies in a range of 500 kHz or higher, and the slow repetition rate of the sampling sequences, which in this case lies in the range around 50 kHz. At the output the low-pass filter must be designed, corresponding to this low sampling frequency, with a steep drop characteristic above its cutoff frequency in order to suppress crosstalk of the sampling pulses themselves or of the sampling operations on the output. In addition, as the result of an input-side suppression of microphone signals above 25 kHz, i.e., one-half of the lowest sampling frequency, it must be ensured that no aliasing phenomena may occur. For a digital output, for which all internal clock signals run synchronously with the system clock of the built-in device, the requirement for clock suppression in the low-pass filter is less critical.

In the case of sampling signal 122, the effective power consumption of the integrating operational amplifier 13 is reduced by up to a factor r, where $$r=\text{pulse}(I+II)/\text{period duration}(I+II+III)$$

represents the sampling pulse-to-period ratio. The maximum current reduction is achieved when the integrating operational amplifier is switched off during pause times III. For r=0.1, as in the exemplary embodiment explained here, this corresponds to a 90% power savings compared to the operating variant discussed in DE 10 2009 000950.7 A1.

However, the noise downstream from the demodulator increases by the factor 1/sqrt(r) due to the sampling according to the present invention. To compensate for this and to maintain the same signal-to-noise ratio as before, as in the operating variant discussed in DE 10 2009 000950.7 A1, either the sampling voltage may simply be increased by the factor 1/sqrt (r), or the distance between the microphone diaphragm and the backplate may be appropriately reduced, or a combination of both measures may be carried out, so that sensitivity S of the microphone component according to the present invention is increased by exactly this factor 1/sqrt(r). The effects on the diaphragm of the microphone structure as a result of these measures cancel out one another, since the effective force on the diaphragm increases with the square of the applied voltage, i.e., ~1/r, and with the time period over which this voltage is applied, i.e., ~r. Accordingly, the risk of electrostatic collapse of the microphone structure remains unchanged.

The above comparison of the sampling concept discussed in DE 10 2009 000950.7 A1 and the sampling concept modified according to the present invention illustrates that the power consumption of a microphone component under discussion may be significantly reduced using the measures according to the present invention without adverse effects on performance and microphone response.

The adaptation and regulation of the compensation capacitor as well as the monitoring of the microphone function of a component according to the present invention are explained below in conjunction with the variation over time of direct-current voltage offset signal UOffset, illustrated in FIG. 3.

In the exemplary embodiment described here, the compensation capacitor of the component according to the present invention is adjusted a first time during the initialization after "power-up" of the component. This is carried out in steps, the quiescent capacitance of the microphone capacitor being linearly approximated. For this purpose, the direct-current voltage component of the output signal of the demodulator is continuously or at least periodically monitored, and is successively minimized by appropriately changing the capacitance of the compensation capacitor. This procedure results in the stepped signal curve up to point in time t1. At point in time t1 the initialization phase of the microphone component and also the initial adjustment of the compensation capacitor are terminated.

Beginning at point in time t1, the direct-current voltage component is used for monitoring the microphone function of the component. As long as the direct-current voltage component varies around the zero line within a tolerance band specified by limiting value UT, such as in the time period between t1 and t2, the microphone function meets the intended quality criteria. In the exemplary embodiment described here, the tolerance band covers approximately 10% of the voltage range of the demodulated signal. Of course, the position and width of this tolerance band may be selected differently, provided that the microphone and circuit characteristics are primarily taken into account.

At point in time t2 the direct-current voltage offset signal drifts out of the tolerance band due to the fact that the direct-current voltage offset is less than lower limiting value UT. This triggers an automatic readjustment of the compensation capacitor, either instantaneously or after elapse of a waiting period during which the offset signal is consistently outside the limits. The capacitance of the compensation capacitor is now changed in such a way that the direct-current voltage offset once again varies within the predefined tolerance band. This second adaptation is likewise carried out in uniform steps, which is reflected in the stepped signal curve between t2 and t3.

At point in time t4 the direct-current voltage offset increases greatly, and exceeds not only limiting value UT but also a predefined maximum limiting value Umax. In the exemplary embodiment described here, maximum limiting value Umax defines a voltage range about the zero line which covers approximately 30% of the voltage range of the demodulated signal. The maximum voltage range may also be selected differently, depending on the type of application and the component characteristics.

This signal curve, optionally after a certain waiting period, is interpreted as an electrostatic collapse of the microphone capacitor, in which the diaphragm and the counter electrode come into physical contact, i.e., are short-circuited, and remain electrostatically adhered to one another. In this case, optionally after a certain waiting period during which a check is made as to whether the state is consistently maintained, an electrical reset is initiated in which the microphone capacitor is discharged in order to detach the diaphragm from the counter electrode. For this purpose, for example, a dedicated switch system may be provided. The microphone function is not resumed until after a certain waiting period, at point in time t5. The compensation capacitor is then readjusted in order to once again minimize the direct-current voltage offset and keep it within the predefined tolerance band.

Figure 3:
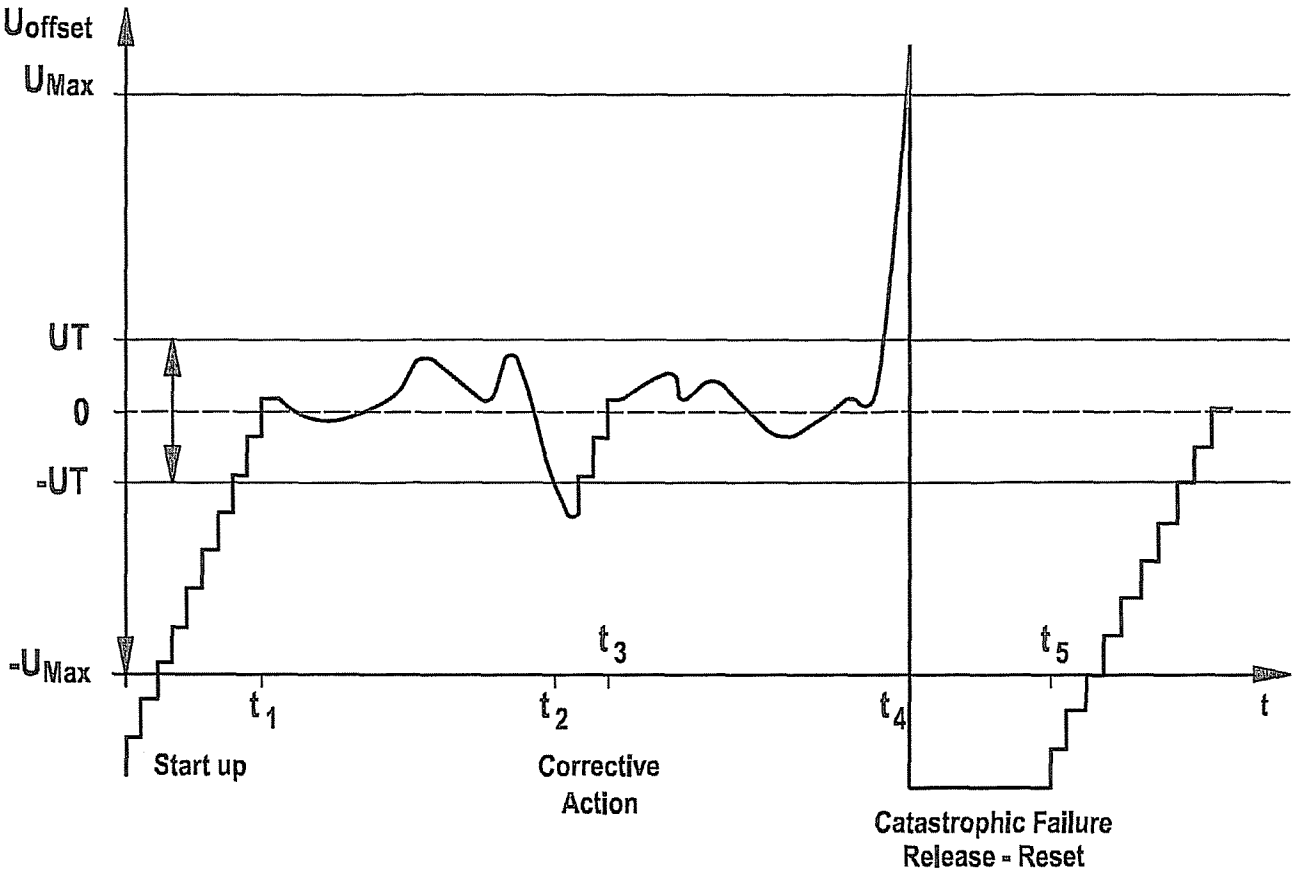
FIG. 3 shows the variation over time of the direct-current voltage offset signal during the initialization of a component according to the present invention and during subsequent operation of the microphone.

Thus, the curve of the direct-current voltage offset signal illustrated in FIG. 3 shows that the compensation capacitor is adjusted once during the start-up phase of the microphone in such a way that the direct-current voltage offset is minimized. During operation of the microphone, the direct-current voltage offset then varies within a predefined tolerance band which indicates normal operation of the microphone. This is monitored continuously, or also only periodically, for example with the aid of comparators, so-called "window comparators," which monitor an allowable operating window. No corrective measures for influencing the microphone function are taken as long as the direct-current voltage offset varies within the predefined tolerance band. Only in rare cases, for example due to long-term drift phenomena, does the direct-current voltage offset gradually drift from the tolerance band.

In that case, after a certain time during which the deviation is consistently detected, the compensation capacitor is automatically readjusted in order to once again minimize the direct-current voltage offset and limit same to the predefined tolerance band. In overload situations, which result in a breakdown of the microphone function, the direct-current voltage offset changes greatly and exceeds a predefined maximum limiting value which is clearly outside the tolerance band. In such cases, likewise during a waiting period during which the limit continues to be exceeded, a reset is carried out in which the microphone capacitor is completely discharged. The operation of the microphone is not resumed until after a certain waiting period, when it is ensured that the diaphragm has detached from the counter electrode of the microphone capacitor. The compensation capacitor is then also adjusted as in the first start-up phase of the microphone in order to minimize the direct-current voltage offset.

Figure 4A:
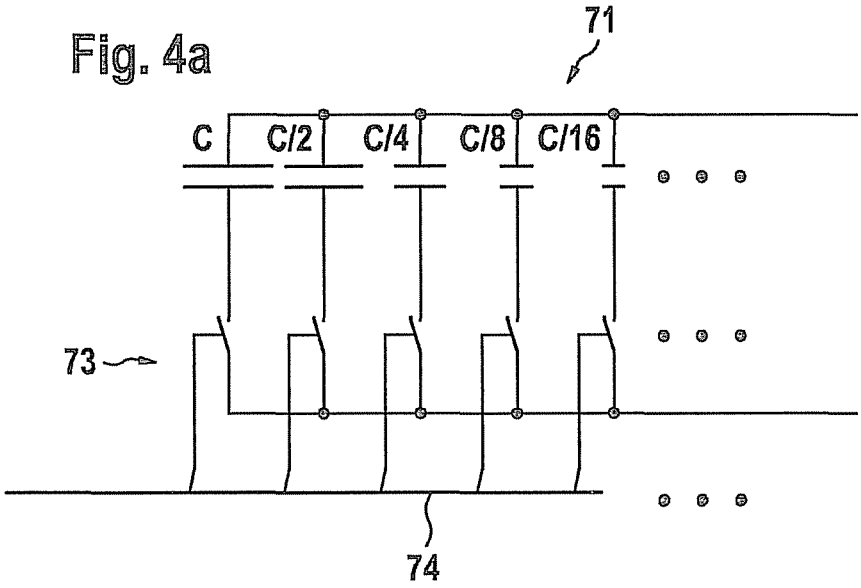
FIGS. 4*a* and 4*b* in each case show an implementation option for the compensation capacitor of a component according to the present invention.
Figure 4B:
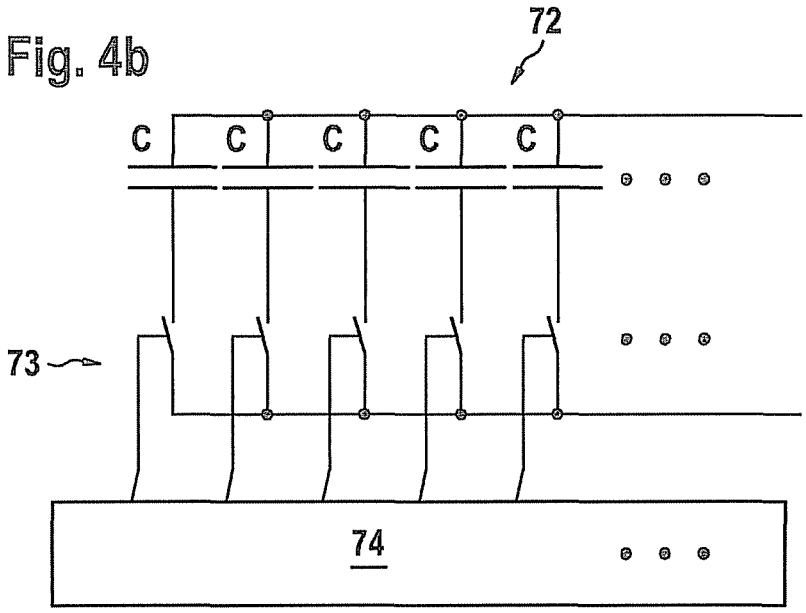

FIGS. 4*a* and 4*b* illustrate two implementation options for an adjustable compensation capacitor. Both cases involve a switchable capacitor bank. Capacitor bank 71 in FIG. 4*a* includes a binary distribution of capacitance values, namely, C, C/2, C/4, . . . , which may also be optionally connected via analog switches 73, while capacitor bank 72 in FIG. 4*b* is composed of a series of identical capacitances which likewise may be optionally connected. In both cases the analog switches are controlled via a binary decoder 74.

As previously mentioned, the compensation capacitor is usually adjusted in steps.

For a linear approximation process as used in FIG. 3, the iteration starts at a predefined capacitance value which corresponds to a given digital counter value of the binary decoder. This may be either the largest possible capacitance or the smallest achievable capacitance of the compensation capacitor system. However, a capacitance value therebetween, for example, which is based on an estimation, may also be selected. Depending on whether the direct-current voltage offset has been increased or decreased due to the adjustment made to the compensation capacitor, the counter value of the binary decoder is incremented by one or decremented by one, resulting in a corresponding increase or decrease, respectively, in capacitance. This procedure is repeated until the direct-current voltage offset is at a minimum or at least varies within the predefined tolerance band. In this case, up to 128 iteration steps are necessary for a 7-bit decoder.

Figure 5:
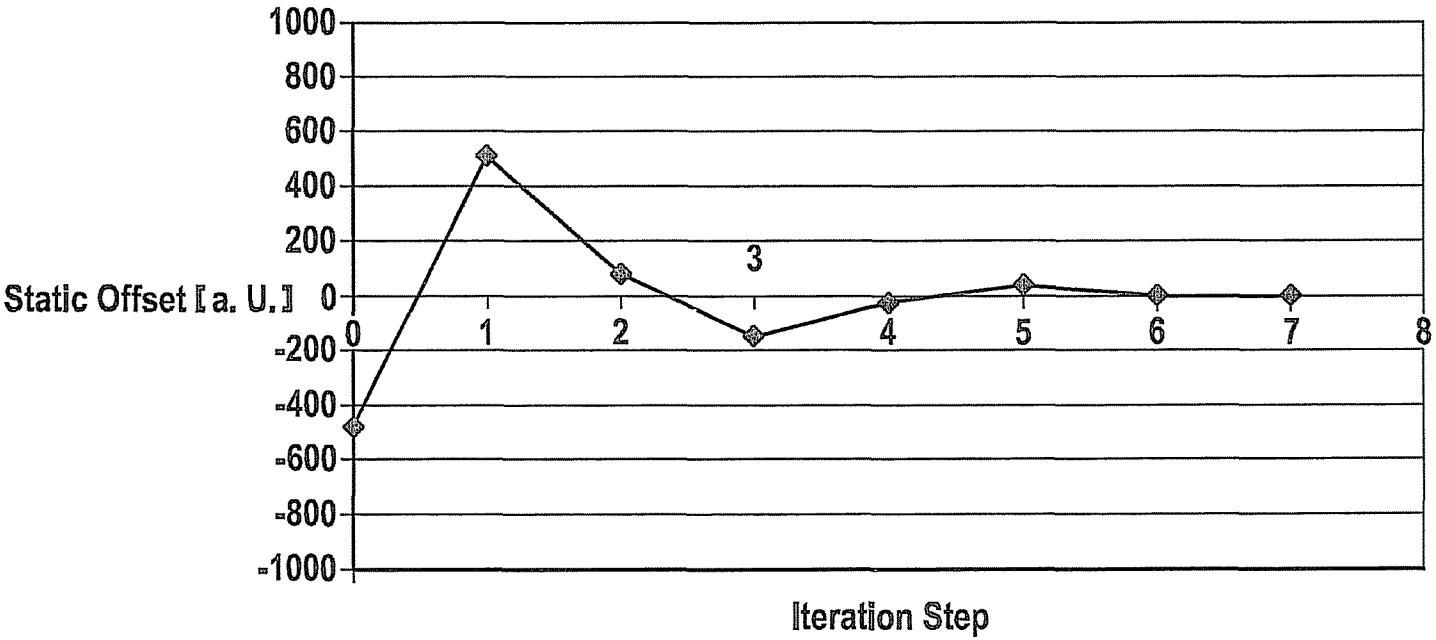
FIG. 5 shows the variation over time of the direct-current voltage offset signal for the case of a binary adaptation of the compensation capacitor.

FIG. 5 illustrates a binary approximation process for adjusting the compensation capacitor. In this case the iteration is carried out bit-by-bit, based on the decoder control word. In the exemplary embodiment described here, at the start of the iteration all bits of the control word are set to zero, which corresponds to the smallest capacitance which is achievable by the compensation capacitor system. This capacitance is then increased by setting the first bit. The direct-current voltage offset is then compared to the zero line in order to determine whether the connected capacitance was too large or not large enough to achieve optimal adaptation. If the capacitance was too large, it is switched off and the corresponding bit is reset to zero. Otherwise, the connected capacitance is maintained. The same procedure is followed with the next bit of the decoder control word. FIG. 5 shows the curve of the direct-current voltage offset for the first seven bits of the decoder control word, which corresponds to seven iteration steps. The algorithm described here is very stable with respect to asymmetries which typically occur for capacitances in integrated circuits. In addition, a binary approximation requires fewer iteration steps than a linear approximation, although a larger capacitance range is covered.

What is claimed is:

1. A microphone component, comprising:

a micromechanical microphone capacitor;

an acoustically inactive compensation capacitor;

a sampling signal arrangement to apply a high-frequency sampling signal to the microphone capacitor and to apply an inverted sampling signal to the compensation capacitor;

an integrating operational amplifier which integrates a sum of a current flow through the microphone capacitor and a current flow through the compensation capacitor;

a demodulator, which is synchronized with the sampling signal, for the output signal of the integrating operational amplifier; and a low-pass filter for obtaining a microphone signal, which corresponds to the changes in capacitance of the microphone capacitor, from the output signal of the demodulator;

wherein the sampling signal is composed of a periodic sequence of sampling pulses and pause times, wherein at least one first switching element reduces the current flow through the integrating operational amplifier during the pause times, and wherein the low-pass filter has a "sample-and-hold" characteristic so that during the pause times the low-pass filter in each case stores the output signal of the integrating operational amplifier averaged over the preceding sampling operation.

2. The microphone component of claim 1, further comprising:

circuit elements which switch off further circuit components during the pause times.

3. The microphone component of claim 1, wherein the demodulator includes at least one second switching element via which the electrical connection between the integrating operational amplifier and the downstream low-pass filter is interrupted during the pause times.

4. The microphone component of claim 1, wherein the compensation capacitor is adjustable, further comprising:

an adapting arrangement to automatically adapt the compensation capacitor to a quiescent capacitance of the microphone capacitor, the arrangement including an offset filter which is used to ascertain the quasi-static component of the demodulator output signal, a monitoring and evaluating arrangement to monitor and evaluate the quasi-static component and for initiating a regulation operation, and a regulation component to regulate the compensation capacitor so that the direct-current voltage component of the demodulator output signal is minimized.

5. The microphone component of claim 4, wherein the upper limiting frequency of the offset filter is considerably less than the lower limiting frequency of the microphone.

6. The microphone component of claim 4, wherein the monitoring and evaluating arrangement includes at least one window comparator which is used to monitor whether the direct-current voltage component varies at least largely within predefined limits.

7. The microphone component of claim 6, wherein the regulation component includes an initiating arrangement to initiate an electrical reset.

8. The microphone component of claim 4, wherein the adjustable compensation capacitor includes a switchable capacitor bank in combination with a switchable resistor series.

9. The microphone component of claim 4, wherein at least one regulatable reference capacitor for noise and interference signal suppression, which is regulated together with the compensation capacitor, is provided upstream from the reference input of the integrating operational amplifier.

10. The microphone component of claim 1, wherein the output signal is output in digital form.

11. A method for operating a microphone component having a micromechanical microphone capacitor and an acoustically inactive compensation capacitor, the method comprising:

applying a high-frequency sampling signal to the microphone capacitor, and applying the inverted clock signal to the compensation capacitor;

integrating the sum of the current flow through the microphone capacitor and the current flow through the compensation capacitor with an integrating operational amplifier; and demodulating the output signal of the integrating operational amplifier with a demodulator which is synchronized with the sampling signal, and a microphone signal which corresponds to the changes in capacitance of the microphone capacitor being obtained by low-pass filtering of the demodulated signal;

wherein the sampling signal is composed of a periodic sequence of sampling pulses and pause times, wherein the current flow through the integrating operational amplifier is reduced during the pause times, wherein the electrical connection between the integrating operational amplifier and the downstream low-pass filter is interrupted during the pause times, and wherein during the pause times the low-pass filter in each case stores the output signal of the integrating operational amplifier averaged over the preceding sampling operation.

12. The method of claim 11, wherein the integrating operational amplifier is switched off during the pause times.

13. The method of claim 11, further comprising:

further circuit components which are switched off during the pause times.

14. The method of claim 11, wherein the sampling signal is composed of a sequence of alternating positive and negative sampling pulses, in each case followed by a defined pause time.

15. The method of claim 11, wherein the sampling signal is composed of a sequence of two sampling pulses of opposite polarity, followed by a defined pause time.

16. The method of claim 11, wherein the sampling pulse voltage is increased to such an extent that the increase in the noise level N resulting from the sampling is at least partially compensated for by the increase in the signal level S in the signal-to-noise ratio SNR=S/N.

17. The method of claim 11, the compensation capacitor being adjustable, wherein the compensation capacitor is adapted at least one of in steps, linearly, and in a binary search algorithm.

18. The method of claim 17, wherein the compensation capacitor is automatically adapted to the quiescent capacitance of the microphone capacitor during the initialization of the microphone component.

19. The method of claim 11, wherein the direct-current voltage component of the demodulated signal is monitored one of routinely, periodically, and continuously during operation of the microphone.

20. The method of claim 19, wherein an electrical reset is initiated in which the microphone capacitor is completely discharged when the direct-current voltage component exceeds a predefined maximum limiting value Umax over a predefined time period.

21. The method of claim 17, wherein the compensation capacitor is automatically adapted when the direct-current voltage component departs from a tolerance band, which is specified by a further limiting value, over a predefined time period.

22. The method of claim 16, wherein accelerations which act perpendicularly to the diaphragm of the microphone capacitor are detected by evaluating the direct-current voltage component of the demodulated signal.

23. The method of claim 11, wherein the output signal of the microphone component is output as a digital signal, which is one of a bit stream (sigma-delta) and a pulse width-modulated (PWM) signal, synchronously with the system clock of the built-in device.

* * * * *